US009591934B1

(12) United States Patent
Sebesta

(10) Patent No.: US 9,591,934 B1
(45) Date of Patent: Mar. 14, 2017

(54) CLOSET REFLECTION SYSTEM

(71) Applicant: John Joseph Sebesta, St. Petersburg, FL (US)

(72) Inventor: John Joseph Sebesta, St. Petersburg, FL (US)

( * ) Notice: Subject to any disclaimer, the term of this patent is extended or adjusted under 35 U.S.C. 154(b) by 0 days.

(21) Appl. No.: 15/083,671

(22) Filed: Mar. 29, 2016

Related U.S. Application Data

(60) Provisional application No. 62/140,548, filed on Mar. 31, 2015.

(51) Int. Cl.
*A47G 1/16* (2006.01)
*A47G 1/24* (2006.01)

(52) U.S. Cl.
CPC ..... *A47G 1/1653* (2013.01); *A47G 1/166* (2013.01); *A47G 1/24* (2013.01)

(58) Field of Classification Search
CPC ..... A47G 1/16; A47G 1/166; A47G 1/1653; A47G 1/24; A47B 61/00; A47B 61/06
USPC ..... 312/224, 226, 245, 246, 334.23; 52/29, 52/32
See application file for complete search history.

(56) References Cited

U.S. PATENT DOCUMENTS 3,591,979 A * 7/1971 Graber ..... A47B 67/005 49/409
2007/0278914 A1* 12/2007 Verfaillie ..... A47B 61/00 312/226

FOREIGN PATENT DOCUMENTS

CN 201032933 Y * 3/2008

* cited by examiner

*Primary Examiner* — Robert Canfield

(57) ABSTRACT

An upper component is horizontally oriented and formed with upper and lower surfaces and front and rear edges. A hook extends upwardly from a central extent of the upper surface. An anti-tipping leg has a lower end attached to the rear edge. A slider assembly is formed with a fixed plate attached to the lower surface of the upper component and a movable plate below the upper component. The slider assembly is also formed with an intermediate plate slidably coupled between the fixed plate and the movable plate. The slider assembly includes a clip in an inverted U-shaped configuration depending from the movable plate.

4 Claims, 3 Drawing Sheets

FIG. 5
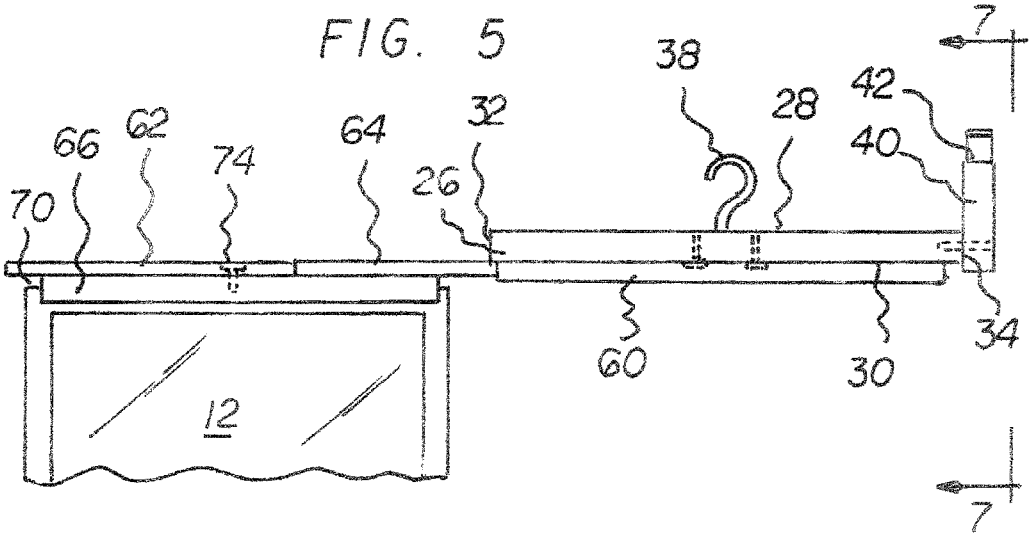
FIG. 6
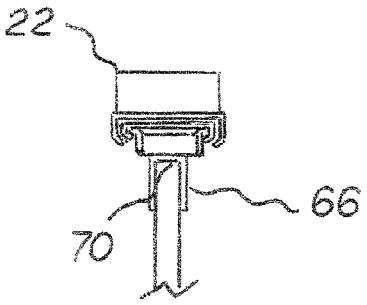
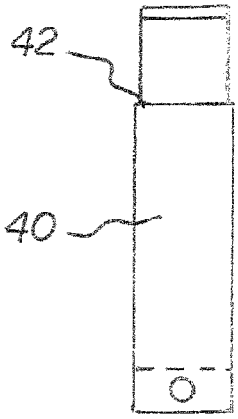
FIG. 7

CLOSET REFLECTION SYSTEM

RELATED APPLICATION

The present application is based upon Provisional Application No. 62/140,548 filed Mar. 31, 2015 entitled "Closet Reflection System," the subject matter of which is incorporated herein by reference.

BACKGROUND OF THE INVENTION

Field of the Invention

The present invention relates to a closet reflection system and more particularly pertains to storing a mirror in a closet and sliding the mirror between a retracted inoperative location in the closet and an extended operative location outside the closet in a safe, convenient, and economical manner.

Description of the Prior Art

The use of mirror systems of known designs and configurations is known in the prior art. More specifically, mirror systems of known designs and configurations previously devised and utilized for the purpose of storing a mirror in a closet are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, the aforementioned patents do not describe closet reflection system that allows the storing of a mirror in a closet and sliding the mirror between a retracted inoperative location in the closet and an extended operative location outside the closet in a safe, convenient, and economical manner.

In this respect, the closet reflection system according to the present invention substantially departs from the conventional concepts and designs of the prior art, and in doing so provides an apparatus primarily developed for the purpose of storing a mirror in a closet and sliding the mirror between a retracted inoperative location in the closet and an extended operative location outside the closet in a safe, convenient, and economical manner.

Therefore, it can be appreciated that there exists a continuing need for a new and improved closet reflection system which can be used for storing a mirror in a closet and sliding the mirror between a retracted inoperative location in the closet and an extended operative location outside the closet in a safe, convenient, and economical manner. In this regard, the present invention substantially fulfills this need.

SUMMARY OF THE INVENTION

In view of the disadvantages inherent in the known types of mirror systems of known designs and configurations now present in the prior art, the present invention provides an improved closet reflection system. As such, the general purpose of the present invention, which will be described subsequently in greater detail, is to provide a new and improved closet reflection system and method which has all the advantages of the prior art and none of the disadvantages.

To attain this, in a broad context, first provided is an upper component horizontally oriented and formed with upper and lower surfaces and front and rear edges. A hook extends upwardly from a central extent of the upper surface. An anti-tipping leg has a lower end attached to the rear edge of the upper component. A slider assembly is formed with a fixed plate attached to the lower surface of the upper component and with a movable plate below the upper component. The slider assembly is also formed with an intermediate plate slidably coupled between the fixed plate and the movable plate. The slider assembly includes a clip in an inverted U-shaped configuration depending from the movable plate. Such components are individually configured and correlated with respect to each other so as to attain the desired objective.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including such equivalent constructions insofar as they do not depart from the spirit and scope of the present invention.

It is therefore an object of the present invention to provide a new and improved closet reflection system which has all of the advantages of the prior art mirror systems of known designs and configurations and none of the disadvantages:

It is another object of the present invention to provide a new and improved closet reflection system which may be easily and efficiently manufactured and marketed.

It is a further object of the present invention to provide a new and improved closet reflection system which is of durable and reliable constructions.

An even further object of the present invention is to provide a new and improved closet reflection system which is susceptible of a low cost of manufacture with regard to both materials and labor, and which accordingly is then susceptible of low prices of sale to the consuming public, thereby making such closet reflection system economically available to the buying public.

Lastly, it is an object of the present invention to provide a closet reflection system for storing a mirror in a closet and sliding the mirror between a retracted inoperative location in the closet and an extended operative location outside the closet in a safe, convenient, and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an enlarged showing of the extended slide assembly in the extended operative orientation.

FIG. 6 is an enlarged side elevational view taken along line 6-6 of FIG. 1.

FIG. 7 is an enlarged side elevational view taken along line 7-7 of FIG. 5.

The same reference numerals refer to the same parts throughout the various Figures.

DESCRIPTION OF THE PREFERRED EMBODIMENT

Figure 1:
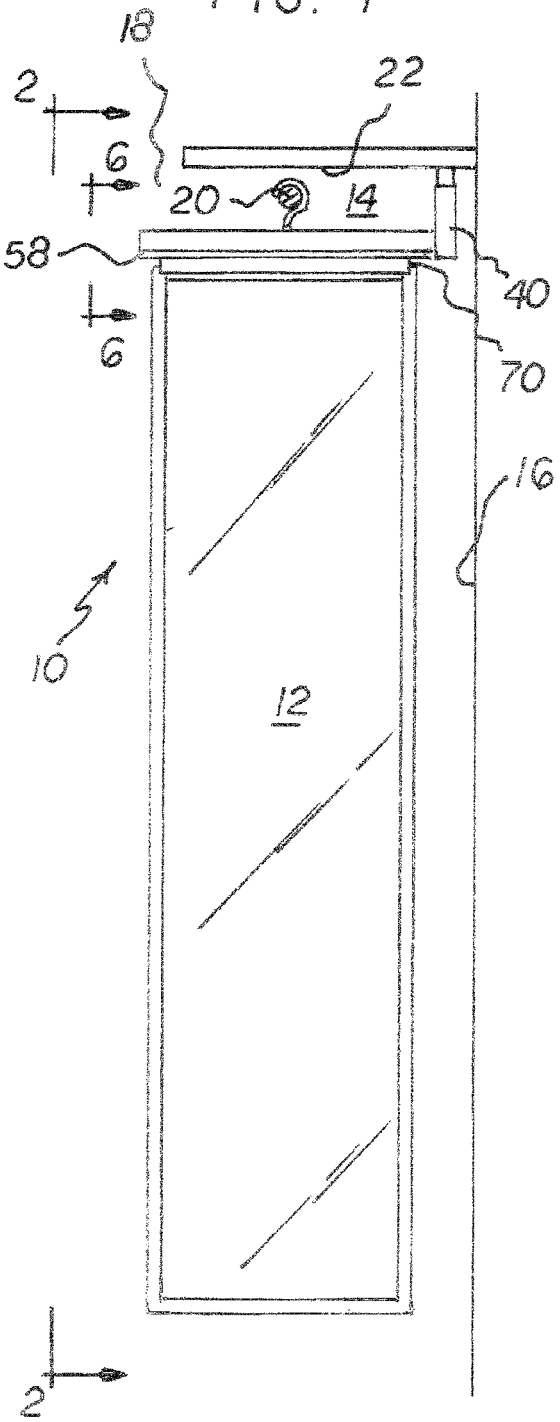
FIG. 1 is a front elevational view of a closet reflection system constructed in accordance with the principles of the present invention.
Figure 2:
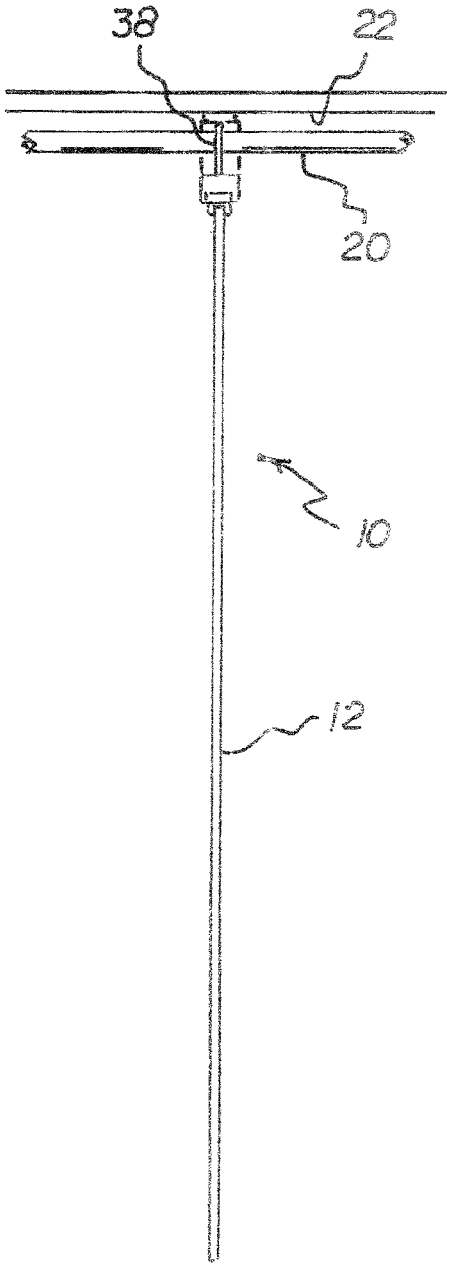
FIG. 2 is a side elevational view taken along line 2-2 of FIG. 1.
Figure 3:
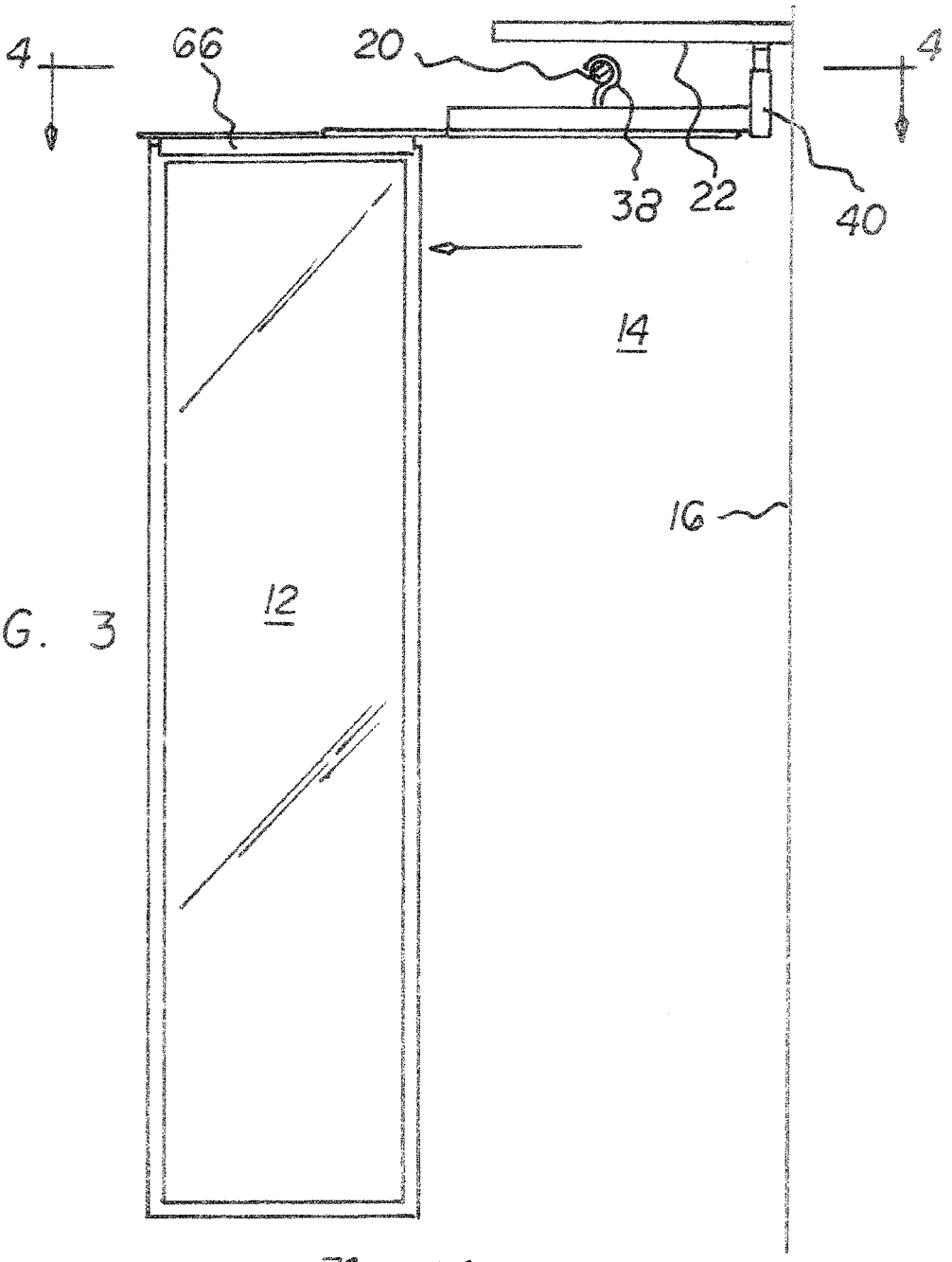
FIG. 3 is a front elevational view similar to FIG. 1 but with the slide assembly and mirror extended in an operative orientation.
Figure 4:
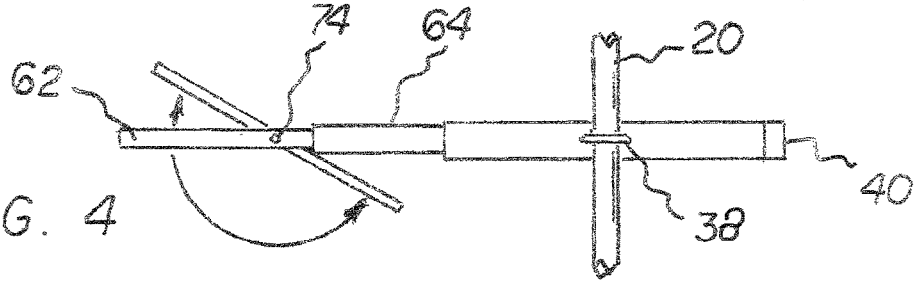
FIG. 4 is a cross sectional view taken along line 4-4 of FIG. 3.

With reference now to the drawings, and in particular to FIG. 1 thereof, the preferred embodiment of the new and improved closet reflection system embodying the principles and concepts of the present invention and generally designated by the reference numeral 10 will be described.

The present invention, the closet reflection system 10 is comprised of a plurality of components. Such components in their broadest context include an upper component and a slider assembly. Such components are individually configured and correlated with respect to each other so as to attain the desired objective.

From a specific perspective, in the preferred embodiment of the closet reflection system, designated by reference numeral 10, first provided is a closet 14 having a back wall 16 and an open front 18. The closet has a support rod 20 having a cylindrical configuration. The support rod is horizontally oriented between, and parallel with, the back wall and the open front. A shelf 22 is located within the closet. The shelf is secured to the back wall and horizontally oriented above the support rod.

Next provided is an upper component 26. The upper component is elongated and has a square cross sectional configuration. The upper component is horizontally oriented and formed with an upper surface 28, a lower surface 30, a front edge 32, and a rear edge 34. A hook 38 extends upwardly from a central extent of the upper surface of the upper component. The hook is removably supported on the support rod. An anti-tipping leg 40 is provided. The anti-tipping leg has a lower end attached to the rear edge of the upper component. The anti-tipping leg has an upper end contacting the shelf. The anti-tipping leg has adjustment mechanisms 42 for varying the length of the anti-tipping leg.

Next, in the preferred embodiment, a slider assembly 58 is provided. The slider assembly is formed with a fixed plate 60 attached to the lower surface of the upper component. The slider assembly is formed with a movable plate 62 located beneath the upper component. The slider assembly is formed with an intermediate plate 64 slidably coupled between the fixed plate and the movable plate. The slider assembly includes a clip 66 in an inverted U-shaped configuration secured to and depending downwardly from the movable plate.

Next provided is a mirror 12 formed in a rectangular configuration with a linear top 70 received in, and depending downwardly from the clip. The slider assembly facilitates the reciprocation of the lower component and mirror between a retracted inoperative location in the closet and an extended operative location outside the closet. It should be understood that in alternate embodiments of the invention, the mirror may be in any of a plurality of sizes and shapes at the discretion of a user.

Lastly, in the preferred embodiment, a pivot pin 74 is provided. The pivot pin has a vertical axis. The pivot pin couples the movable plate and the clip thereby facilitating the rotation of the mirror about a vertical axis of rotation.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A closet reflection system comprising:

an upper component horizontally oriented and formed with upper and lower surfaces and a front edge and a rear edge, a hook extending upwardly from a central extent of the upper surface of the upper component, an anti-tipping leg having a lower end attached to the rear edge of the upper component; and a slider assembly formed with a fixed plate attached to the lower surface of the upper component, the slider assembly formed with a movable plate below the upper component, the slider assembly formed with an intermediate plate slidably coupled between the fixed plate and the movable plate, the slider assembly including a clip in an inverted U-shaped configuration depending from the movable plate.

2. The system as set forth in claim 1 and further including a pivot pin having a vertical axis coupling the movable plate and the clip.

3. The system as set forth in claim 1 wherein the clip is adapted to receive and support a mirror extending downwardly from the clip.

4. A closet reflection system (10) for storing a mirror (12) in a closet (14) and for sliding the mirror between a retracted inoperative location in the closet and an extended operative location outside the closet, the storing and the sliding being done in a safe, convenient, and economical manner, the system comprising, in combination:

the closet (14) having a back wall (16) and an open front (18) and a support rod (20) having a cylindrical configuration, the support rod being horizontally oriented between, and parallel with, the back wall and the open front, a shelf (22) located within the closet, the shelf being secured to the back wall, the shelf being horizontally oriented above the support rod;

an upper component (26) being elongated and having a square cross sectional configuration, the upper component being horizontally oriented and formed with an upper surface (28) and a lower surface (30) and a front edge (32) and a rear edge (34), a hook (38) extending upwardly from a central extent of the upper surface of the upper component, the hook being removably supported on the support rod, an anti-tipping leg (40) having a lower end attached to the rear edge of the upper component, the anti-tipping leg having an upper end contacting the shelf, the anti-tipping leg having adjustment mechanisms (42) for varying the length of the anti-tipping leg; and a slider assembly (58) formed with a fixed plate (60) attached to the lower surface of the upper component, the slider assembly formed with a movable plate (62) located beneath the upper component, the slider assembly formed with an intermediate plate (64) slidably coupled between the fixed plate and the movable plate, the slider assembly including a clip (66) in an inverted U-shaped configuration secured to and depending downwardly from the movable plate;

the mirror formed in a rectangular configuration with a linear top (70) received in, and depending downwardly from the clip, the slider assembly facilitating the reciprocation of the lower component and mirror between a retracted inoperative location in the closet and an extended operative location outside the closet; and a pivot pin (74) having a vertical axis, the pivot pin coupling the movable plate and the clip thereby facilitating the rotation of the mirror about a vertical axis of rotation.

* * * * *